US006377659B1

(12) United States Patent
Snyder et al.

(10) Patent No.: US 6,377,659 B1
(45) Date of Patent: Apr. 23, 2002

(54) X-RAY TUBES AND X-RAY SYSTEMS HAVING A THERMAL GRADIENT DEVICE

(75) Inventors: Douglas J. Snyder, Brookfield, WI (US); Eric Chabin, Bangalore (IN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 09/751,529

(22) Filed: Dec. 29, 2000

(51) Int. Cl.[7] ..... H01J 35/10

(52) U.S. Cl. ..... 378/142; 378/127; 313/11; 313/46

(58) Field of Search ..... 378/127, 142, 378/141, 121, 128, 130, 199; 313/11, 30, 46

(56) References Cited

U.S. PATENT DOCUMENTS

| | | | | | |
|---|---|---|---|---|---|
| 3,694,685 | A | | 9/1972 | Houston | 378/130 |
| 4,165,472 | A | | 8/1979 | Wittry | 378/127 |
| 4,455,504 | A | | 6/1984 | Iversen | 313/30 |
| 4,622,687 | A | | 11/1986 | Whitaker et al. | 378/130 |
| 4,674,109 | A | | 6/1987 | Ono | 378/130 |
| 4,916,015 | A | * | 4/1990 | Schaffner et al. | 378/141 |
| 4,945,562 | A | | 7/1990 | Staub | 378/130 |
| 4,969,172 | A | | 11/1990 | Fengler et al. | 378/125 |
| 5,091,927 | A | | 2/1992 | Golitzer et al. | 378/130 |
| 5,416,820 | A | | 5/1995 | Weil et al. | 378/130 |
| 5,541,975 | A | * | 7/1996 | Anderson et al. | 378/130 |
| 5,579,364 | A | | 11/1996 | Osaka et al. | 378/130 |
| 5,652,778 | A | | 7/1997 | Tekriwal | 378/132 |
| 5,655,000 | A | * | 8/1997 | Benz et al. | 378/144 |
| 5,673,301 | A | | 9/1997 | Tekriwal | 378/130 |
| 5,995,584 | A | | 11/1999 | Bhatt | 378/125 |
| 6,021,174 | A | | 2/2000 | Campbell | 378/125 |
| 6,295,338 | B1 | * | 9/2001 | Kuzinar et al. | 378/132 |
| 6,327,340 | B1 | * | 12/2001 | Runnoe | 378/130 |

* cited by examiner

*Primary Examiner*—Drew Dunn
(74) *Attorney, Agent, or Firm*—Kilpatrick Stockton LLP; Charles W. Calkins; Christopher L. Bernard

(57) ABSTRACT

A thermal energy transfer device for use with an x-ray generating device or x-ray system including an anode assembly having a target, a cathode assembly positioned at a distance from the anode assembly configured to emit electrons that strike the target producing x-rays and residual energy in the form of heat, and a rotatable shaft supported by a bearing assembly. The thermal energy transfer device including a thermal gradient device positioned adjacent to and in thermal communication with one end of the shaft, the thermal gradient device operable for transferring heat away from that end of the shaft, and a fin structure positioned adjacent to and in thermal communication with the thermal gradient device, the fin structure operable for convectively cooling the thermal gradient device.

47 Claims, 4 Drawing Sheets

X-RAY TUBES AND X-RAY SYSTEMS HAVING A THERMAL GRADIENT DEVICE

BACKGROUND OF THE INVENTION

The present invention relates generally to a thermal energy transfer device for use with an x-ray generating device and, more specifically, to a thermal gradient device for use with an x-ray tube.

Typically, an x-ray generating device, referred to as an x-ray tube, includes opposed electrodes enclosed within a cylindrical vacuum vessel. The vacuum vessel is commonly fabricated from glass or metal, such as stainless steel, copper, or a copper alloy. The electrodes include a cathode assembly positioned at some distance from the target track of a rotating, disc-shaped anode assembly. Alternatively, such as in industrial applications, the anode assembly may be stationary. The target track, or impact zone, of the anode is generally fabricated from a refractory metal with a high atomic number, such as tungsten or a tungsten alloy. Further, to accelerate electrons used to generate x-rays, a voltage difference of about 60 kV to about 140 kV is commonly maintained between the cathode and anode assemblies. The hot cathode filament emits thermal electrons that are accelerated across the potential difference, impacting the target zone of the anode assembly at high velocity. A small fraction of the kinetic energy of the electrons is converted to high-energy electromagnetic radiation, or x-rays, while the balance is contained in back-scattered electrons or converted to heat. The x-rays are emitted in all directions, emanating from a focal spot, and may be directed out of the vacuum vessel along a focal alignment path. In an x-ray tube having a metal vacuum vessel, for example, an x-ray transmissive window is fabricated into the vacuum vessel to allow an x-ray beam to exit at a desired location. After exiting the vacuum vessel, the x-rays are directed along the focal alignment path to penetrate an object, such as a human anatomical part for medical examination and diagnostic purposes. The x-rays transmitted through the object are intercepted by a detector or film, and an image of the internal anatomy of the object is formed. Likewise, industrial x-ray tubes may be used, for example, to inspect metal parts for cracks or to inspect the contents of luggage at an airport.

Since the production of x-rays in a medical diagnostic x-ray tube is by its very nature an inefficient process, the components in an x-ray tube operate at elevated temperatures. For example, the temperature of the anode's focal spot may run as high as about 2,700 degrees C., while the temperature in other parts of the anode may run as high as about 1,800 degrees C. The thermal energy generated during tube operation is typically transferred from the anode, and other components, to the vacuum vessel. The vacuum vessel, in turn, is generally enclosed in a casing filled with a circulating cooling fluid, such as dielectric oil, that removes the thermal energy from the x-ray tube. Alternatively, in mammography applications, for example, the vacuum vessel, which is not contained within a casing, may be cooled directly with air. The casing, when used, also supports and protects the x-ray tube and provides a structure for mounting the tube. Additionally, the casing is commonly lined with lead to shield stray radiation.

As discussed above, the primary electron beam generated by the cathode of an x-ray tube deposits a large heat load in the anode target and rotor assembly. In fact, the target glows red-hot in operation. Typically, less than 1% of the primary electron beam energy is converted into x-rays, the balance being converted to thermal energy. This thermal energy from the hot target is conducted and radiated to other components within the vacuum vessel. The fluid circulating around the exterior of the vacuum vessel transfers some of this thermal energy out of the system. However, the high temperatures caused by this thermal energy subject the x-ray tube components to high thermal stresses that are problematic in the operation and reliability of the x-ray tube. This is true for a number of reasons. First, the exposure of components in the x-ray tube to cyclic high temperatures may decrease the life and reliability of the components. In particular, the anode assembly is subject to thermal growth and target burst. The anode assembly also typically includes a shaft that is rotatably supported by a bearing assembly. This bearing assembly is very sensitive to high heat loads. Overheating of the bearing assembly may lead to increased friction, increased noise, and to the ultimate failure of the bearing assembly. This problem is especially acute for mammography systems as a result of the high impact temperatures and tight acoustic noise requirements involved. Due to the high temperatures present, the balls of the bearing assembly are typically coated with a solid lubricant. A preferred lubricant is lead, however, lead has a low melting point and is typically not used in a bearing assembly exposed to operating temperatures above about 330 degrees C. Because of this temperature limit, an x-ray tube with a bearing assembly including a lead lubricant is limited to shorter, less powerful x-ray exposures. Above about 400 degrees C., silver is generally the lubricant of choice, allowing for longer, more powerful x-ray exposures. Silver, however, increases the noise generated by the bearing assembly. Ideally, if the operating temperature of the bearings could be sufficiently reduced, vacuum grease could be used to lubricate the bearings, decreasing noise and increasing rotor speed and bearing life.

The high temperatures encountered within an x-ray tube also reduce the scanning performance or throughput of the tube, which is a function of the maximum operating temperature, and specifically the anode target and bearing temperatures, of the tube. As discussed above, the maximum operating temperature of an x-ray tube is a function of the power and length of x-ray exposure, as well as the time between x-ray exposures. Typically, an x-ray tube is designed to operate at a certain maximum temperature, corresponding to a certain heat capacity and a certain heat dissipation capability for the components within the tube. These limits are generally established with current x-ray routines in mind. However, new routines are continually being developed, routines that may push the limits of existing x-ray tube capabilities. Techniques utilizing higher instantaneous power, longer x-ray exposures, and increased patient throughput are in demand to provide better images and greater patient care. Thus, there is a need to remove as much heat as possible from existing x-ray tubes, as quickly as possible, in order to increase x-ray exposure power and duration before reaching tube operational limits.

The prior art has primarily relied upon removing thermal energy from the x-ray tube through the cooling fluid circulating around the vacuum vessel. It has also relied upon increasing the diameter and mass of the anode target in order to increase the heat storage capability and radiating surface area of the target. These approaches have been marginally effective, however, they are limited. The cooling fluid methods, for example, are not adequate when the anode end of the x-ray tube cannot be sufficiently exposed to the circulating fluid. Likewise, the target modification methods are generally not adequate as the potential diameter of the anode target is ultimately limited by space constraints on the scanning system. Further, a finite amount of time is required for heat to be conducted from the target track, where the electron beam actually hits the anode target, to other regions of the target.

Therefore, what is needed are devices providing cooler running x-ray tube bearings, allowing lubricants such as vacuum grease to be used. This would reduce bearing noise and allow higher rotor speeds to be achieved. Higher rotor speeds would, in turn, greatly reduce the impact temperature of the x-ray tube target created by the electron beam, increasing the operating life of the x-ray tube.

BRIEF SUMMARY OF THE INVENTION

The present invention overcomes the aforementioned problems and permits greater x-ray tube throughput by providing cooler running bearings with higher steady state power capability.

In one embodiment, an x-ray generating device for generating x-rays includes a vacuum vessel having an inner surface forming a vacuum chamber; an anode assembly disposed within the vacuum chamber, the anode assembly including a target; a cathode assembly disposed within the vacuum chamber at a distance from the anode assembly, the cathode assembly configured to emit electrons that strike the target of the anode assembly, producing x-rays and residual energy in the form of heat; a shaft coupled to the vacuum vessel by a bearing assembly, the shaft having a first end and a second end, the first end of the shaft having a support for supporting the target; a thermal gradient device positioned adjacent to and in thermal communication with the second end of the shaft, the thermal gradient device operable for transferring heat away from the second end of the shaft; and a fin structure positioned adjacent to and in thermal communication with the thermal gradient device, the fin structure operable for convectively cooling the thermal gradient device.

In another embodiment, a thermal energy transfer device for use with an x-ray generating device, including an anode assembly having a target, a cathode assembly at a distance from the anode assembly configured to emit electrons that strike the target, producing x-rays and residual energy in the form of heat, and a rotatable shaft supported by a bearing assembly, includes a thermal gradient device positioned adjacent to and in thermal communication with one end of the shaft, the thermal gradient device operable for transferring heat away from that end of the shaft, and a fin structure positioned adjacent to and in thermal communication with the thermal gradient device, the fin structure operable for convectively cooling the thermal gradient device.

In a further embodiment, an x-ray system includes a vacuum vessel having an inner surface forming a vacuum chamber; an electron source disposed within the vacuum chamber, the electron source operable for emitting electrons; an x-ray source disposed within the vacuum chamber, the x-ray source operable for receiving electrons emitted by the electron source, producing x-rays and residual energy in the form of heat; a shaft coupled to the vacuum vessel by a bearing assembly, the shaft having a first end and a second end, the first end of the shaft having a support for supporting the x-ray source; and a thermal energy transfer device positioned adjacent to and in thermal communication with the second end of the shaft, the thermal energy transfer device operable for transferring heat away from the second end of the shaft.

DETAILED DESCRIPTION OF THE INVENTION

In the present invention, a thermal energy transfer device is positioned adjacent to and in thermal communication with the shaft and bearing assembly of an x-ray tube. The thermal energy transfer device, which may be, for example, a thermal gradient device such as a Peltier device, pumps heat away from the shaft and bearing assembly, increasing the steady state power capability of the x-ray tube.

Figure 1:
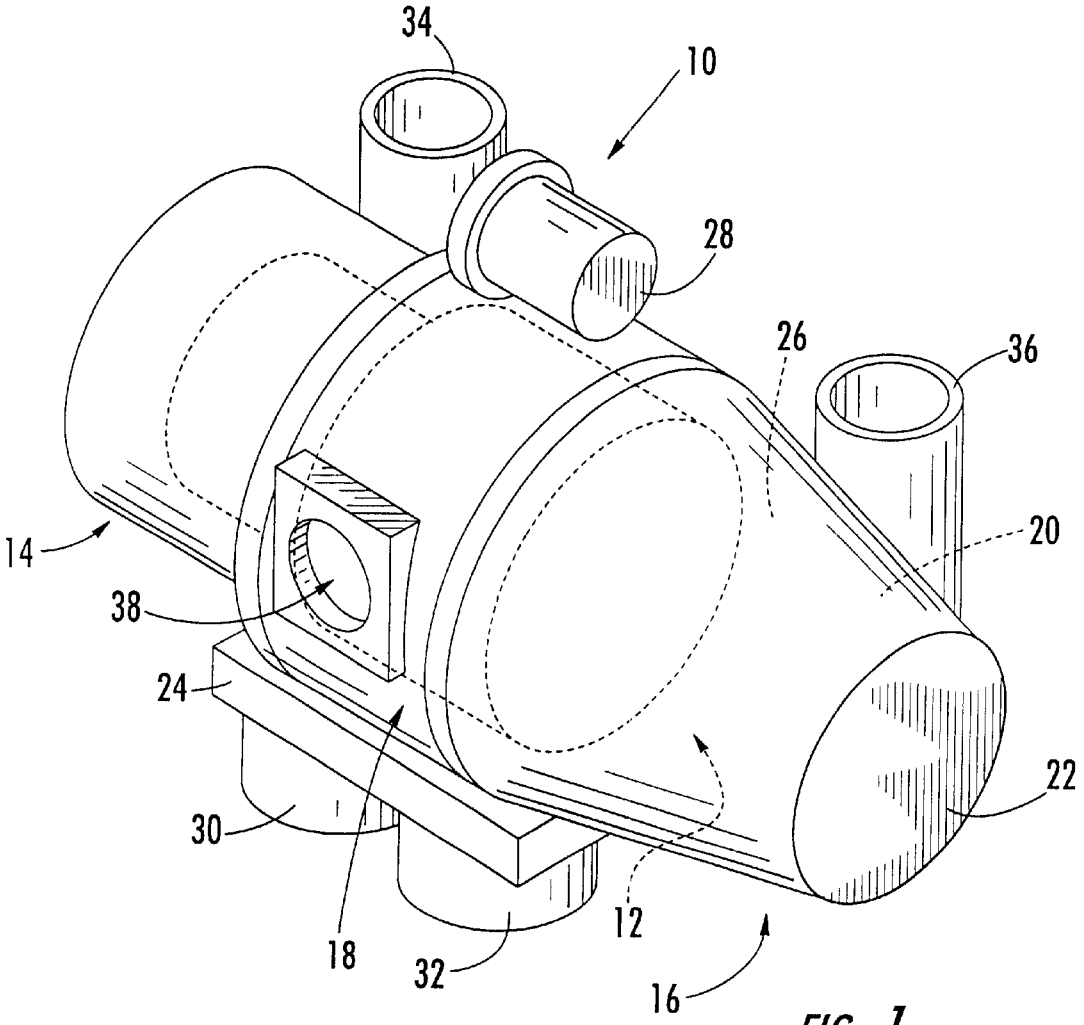
FIG. 1 is a perspective view of an x-ray tube assembly unit that contains an x-ray generating device, or x-ray tube.

Referring to FIG. 1, an x-ray tube assembly unit 10 that contains an x-ray generating device, or x-ray tube 12, includes an anode end 14, a cathode end 16, and a center section 18 positioned between the anode end 14 and the cathode end 16. The x-ray tube 12 is disposed within the center section 18 of the assembly unit 10 in a fluid-filled chamber 20 formed by a casing 22. The casing 22 may, for example, be made of aluminum. The chamber 20 may, for example, be filled with dielectric oil that circulates throughout the casing 22, cooling the operational x-ray tube 12 and insulating the casing 22 from the high electrical charges within the x-ray tube 12. The casing 22 may, optionally, be lead-lined. Alternatively, in mammography applications, for example, the vacuum vessel may be cooled directly with air. The assembly unit 10 also, preferably, includes a radiator 24, positioned to one side of the center section 18, that cools the circulating fluid 26. The fluid 26 may be moved through the chamber 20 and radiator 24 by an appropriate pump 28, such as an oil pump. Preferably, a pair of fans 30, 32 are coupled to the radiator 24, providing a cooling air flow to the radiator 24 as the hot fluid 26 flows through it. Electrical connections to the assembly unit 10 are provided through an optional anode receptacle 34 and a cathode receptacle 36. X-rays are emitted from the x-ray tube assembly unit 10 through an x-ray transmissive window 38 in the casing 22 at the center section 18.

Figure 2:
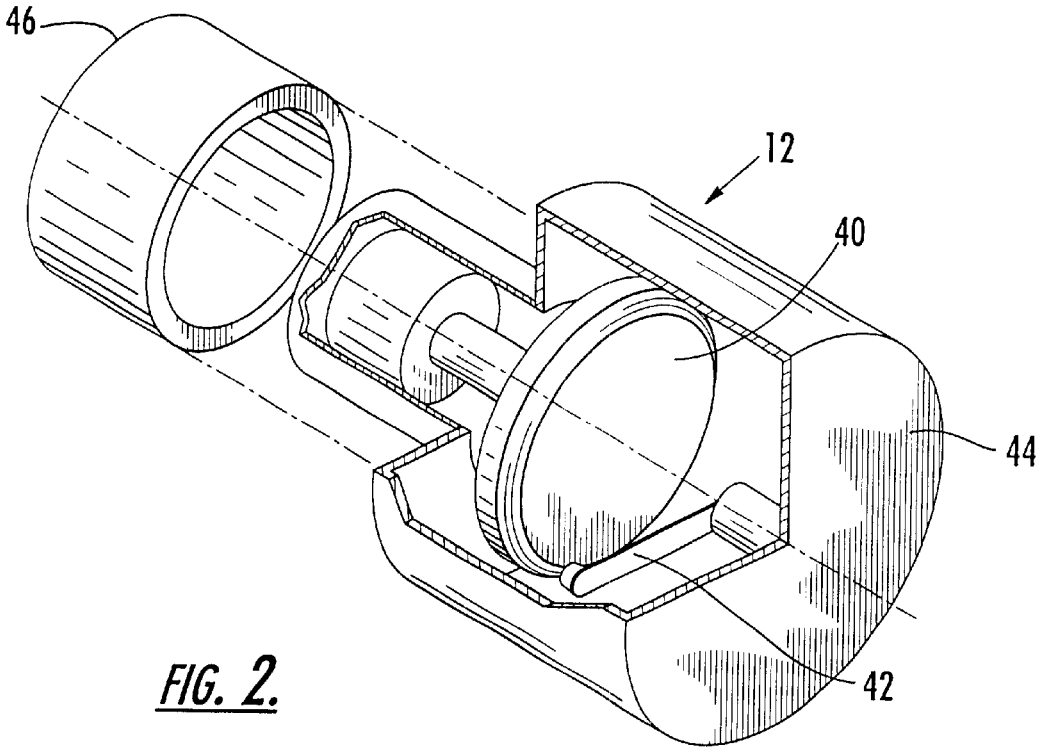
FIG. 2 is a sectional perspective view of an x-ray tube with the stator exploded to reveal a portion of the anode assembly.

Referring to FIG. 2, an x-ray generating device, or x-ray tube 12, includes an anode assembly 40 and a cathode assembly 42 disposed within a vacuum vessel 44. The vacuum vessel 44 may, for example, be made of stainless steel, copper, or glass. The anode assembly 40 may optionally, for medical applications, be rotating. A stator 46 is positioned over the vacuum vessel 44 adjacent to the anode assembly 40. Upon the energization of an electrical circuit connecting the anode assembly 40 and the cathode assembly 42, which produces a potential difference of about 20 kV to about 140 kV between the anode assembly 40 and the cathode assembly 42, electrons are directed from the cathode assembly 42 to the anode assembly 40. The electrons strike a focal spot located within a target zone of the anode assembly 40 and produce high-frequency electromagnetic waves, or x-rays, back-scattered electrons, and residual energy. The residual energy is absorbed by the components within the x-ray tube 12 as heat. The x-rays are directed through the vacuum existing within the vacuum chamber 44 and out of the casing 22 (FIG. 1) through the transmissive window 38 (FIG. 1), toward an object to be imaged, along a focal alignment path. The transmissive window 38 may be made of beryllium, titanium, aluminum, or any other suitable x-ray transmissive material. The transmissive window 38, and optionally an associated aperture and/or filter, collimates the x-rays, thereby reducing the radiation dosage received by, for example, a patient. As an illustration, in CT applications, the useful diagnostic energy range for x-rays is from about 60 keV to about 140 keV. In mammography applications, the useful diagnostic energy range for x-rays is from about 20 keV to about 50 keV. An x-ray system utilizing an x-ray tube 12 may also be used for mammography, radiography, angiography, fluoroscopy, vascular, mobile, and industrial x-ray applications, among others.

Figure 3:
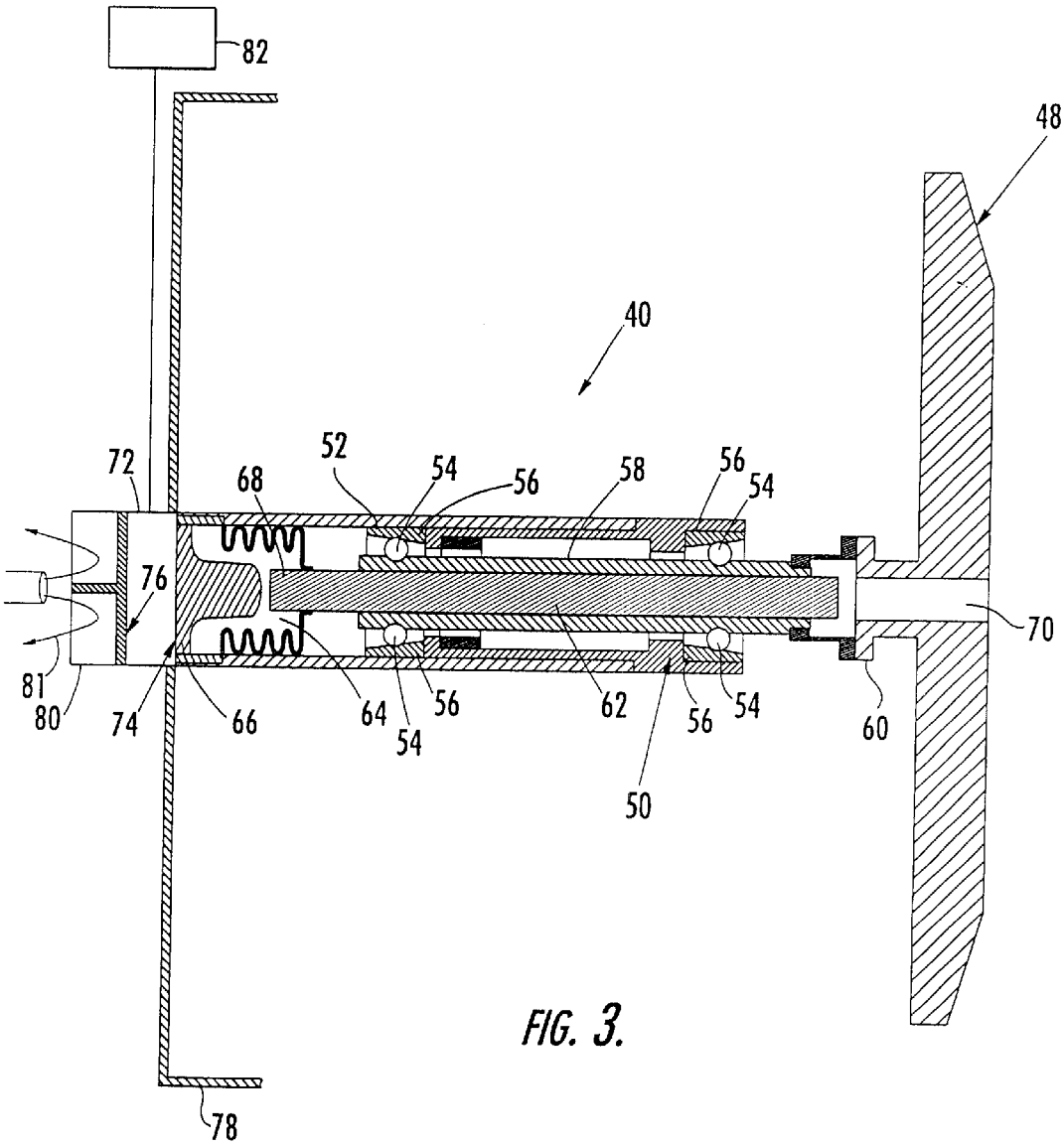
FIG. 3 is a cross-sectional view of one embodiment of an anode assembly of an x-ray tube, including a heat pipe and the thermal energy transfer device of the present invention.

Referring to FIG. 3, in one embodiment, an anode assembly 40 of an x-ray tube 12 (FIGS. 1 and 2) typically includes a target 48 and a bearing assembly 50. The bearing assembly 50 includes a bearing support 52, bearings balls 54, and bearing races 56. The target 48 is a metallic disk made of a refractory metal, optionally with graphite brazed to it. The target 48 is preferably fabricated from a refractory metal with a high atomic number, such as tungsten or a tungsten alloy. The target 48 provides a surface that electrons from the cathode assembly 42 (FIG. 2) strike, producing x-rays and residual thermal energy. Optionally, the target 48 rotates by the rotation of a shaft 58 coupled to the target 48 by a connector 60. The rotation of the target 48 distributes the area of the target 48 that is impacted by electrons. The bearing support 52 is a cylindrical tube that provides support for the anode assembly 40. Bearing balls 54 and bearing races 56 are disposed within the bearing support 52 and provide for rotational movement of the target 48 by providing for rotational movement of the shaft 58. The bearing balls 54 and bearing races 56 are typically made of tool steel or another suitable metal and may become softened and even deformed by excessive heat. As a result, distributing heat away from the bearing balls 54 and bearing races 56 is important to the proper rotational movement of the anode assembly 40 and, therefore, the proper operation of the x-ray tube 12.

The anode assembly 40 may, optionally, include a heat pipe 62 concentrically disposed within the shaft 58. The heat pipe 62 may be, for example, an evacuated, sealed metal pipe partially filled with a working fluid. The heat pipe 62 may be made of copper, titanium, monel, tungsten, or any other suitable high temperature, thermally conductive material. The heat pipe 62 may contain, for example, water, alcohol, nitrogen, ammonia, sodium, or any other suitable working fluid spanning the temperature range from cryogenic to molten lithium. Heat pipes have found wide application in space-based, electronics cooling, and other high heat-flux applications. For example, they may be found in satellites, laptop computers, and solar power generators. Heat pipes have the ability to dissipate very high heat fluxes and heat loads through small cross sectional areas. They have a very large effective thermal conductivity, more than about 10 to about 10,000 times larger than a comparable solid copper conductor, and may move a large amount of heat from source to sink. Advantageously, heat pipes are completely passive and are used to transfer heat from a source to a sink with minimal temperature gradients, or to isothermalized surfaces. The heat pipe 62 utilizes a capillary wick structure, allowing it to operate against gravity by transferring working fluid from a condenser end 68 to an evaporator end 70. In the anode assembly 40, heat from the inner bore of the bearing shaft 58 enters the evaporator end 70 of the heat pipe 62 where the working fluid is evaporated, creating a pressure gradient in the pipe 62. The pressure gradient forces the resulting vapor through the hollow core of the heat pipe 62 to the cooler condenser end 68 where the vapor condenses and releases its latent heat. The fluid is then wicked back by capillary forces through the capillary wick structure of the walls of the heat pipe 62 to the evaporator end 70 and the cycle continues.

An anode assembly 40 utilizing a heat pipe 62 may also, optionally, include corrugated bellows 64 and a plug 66 disposed within the bearing support 52. The corrugated bellows 64 are a metallic structure positioned adjacent to and concentrically surrounding the condenser end 68 of the heat pipe 62. The corrugated bellows 64 provide a compliant seal with the heat pipe 62. The corrugated bellows 64 also act as a heat sink, drawing heat away from the target 48 and bearing assembly 50. The corrugated bellows 64 may be made of any suitable thermally conductive material. Likewise, the plug 66 is a metallic structure made of a heat conductive material, such as copper, positioned adjacent to and in thermal communication with the corrugated bellows 64. The plug 66 also acts as a heat sink, drawing heat away from the target 48 and bearing assembly 50. The corrugated bellows 64 and plug 66 may be disposed within and form a cavity filled with a heat conducting liquid, such as gallium.

As discussed above, the primary electron beam generated by the cathode assembly 42 of an x-ray tube 12 deposits a large heat load in the target 48. In fact, the target 48 glows red-hot in operation. Typically, less than 1% of the primary electron beam energy is converted into x-rays, the balance being converted to thermal energy. This thermal energy from the hot target 48 is conducted and radiated to other components within the vacuum vessel 44 (FIG. 2). The fluid 26 (FIG. 1) circulating around the exterior of the vacuum vessel 44 transfers some of this thermal energy out of the system. However, the high temperatures caused by this energy subject the x-ray tube 12 and its components to high thermal stresses that are problematic in the operation and reliability of the x-ray tube 12 and that reduce its throughput.

Referring again to FIG. 3, the thermal energy transfer device of the present invention includes a thermal gradient device 72 and may include a fin structure 80 for convectively cooling the thermal gradient device 72. The thermal gradient device is a device operable for transferring or pumping heat from a cool side 74 of the device 72 to a hot side 76 of the device 72. The cool side 74 of the device 72 is positioned adjacent to and in thermal communication with the end of the shaft 58, corresponding the condenser end 68 of the heat pipe 62. The plug 66 and the wall 78 of the vacuum vessel 44 may also be disposed between the cool side 74 of the thermal gradient device 72 and the end of the shaft 58. The hot side 76 of the thermal energy transfer device 72 may be positioned adjacent to and in thermal communication with a fin structure 80. The fin structure 80 is a structure having a plurality of horizontally, vertically, or radially-aligned raised ridges or fins. Alternatively, the fin structure 80 may include a plurality of rods, dimples, discs, or any other protruding/recessed structure. The raised protrusions or recessed portions of the fin structure 80 are arranged such that they increase the surface area that contacts a cooling medium 81 flowing past the fin structure 80, convectively cooling the fin structure 80. The fin structure 80 may be made of copper or any other suitable material. The cooling medium 81 may be, for example, air, water, oil, or any other suitable fluid. The cooling medium 81 may be delivered to the fin structure 80 by free convection or forced convection. In the event that the cooling medium 81 is delivered to the fin structure 80 by forced convection, a fan or a pump may be used.

The thermal gradient device 72, discussed above, is, preferably, a Peltier device. A Peltier device is a device that utilizes an electrical current and the Peltier effect to create a temperature gradient. This temperature gradient may result in a temperature difference of up to about 70 degrees C. between the cool side 74 and the hot side 76 of the Peltier device. The Peltier effect, first discovered in the early $19^{th}$ century, occurs when an electrical current flows through two dissimilar conductors. As a result of complex physics at the sub-atomic level, the junction between the two conductors either absorbs or releases heat. Peltier devices are commonly made of Bismuth Telluride, or another suitable semiconductor. Peltier devices are commercially available from, for example, Tellurex Corporation (Traverse City, Mich.) and Melcor (Trenton, N.J.). Peltier devices have no moving parts, and therefore require little or no maintenance. Peltier devices typically operate on a power supply 82 of about 1 to about 15 volts and several amps of current and are capable of transferring up to about 80 W of power. As an example, in a vascular tube application, the power requirement for a Peltier device is about 10 W to about 30 W.

Figure 4:
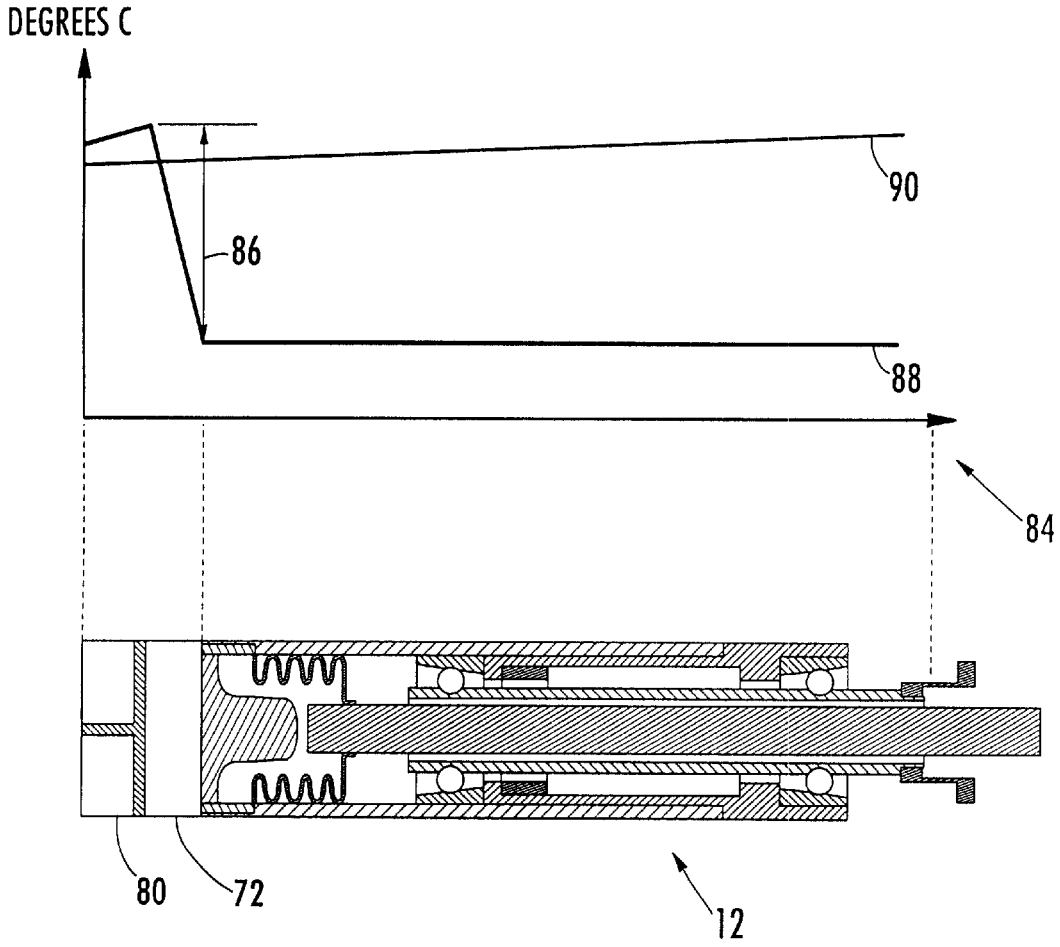
FIG. 4 is a plot of the temperature profile of an x-ray tube with and without the thermal energy transfer device of the present invention.

Referring to the graph 84 of FIG. 4, the use of a thermal gradient device 72, such as a Peltier device, and fin structure 80 in conjunction with an x-ray tube 12 decreases the operating temperature of the x-ray tube 12, and specifically the shaft 58 (FIG. 3) and bearing assembly 50 (FIG. 3), by about 40 degrees C. to about 100 degrees C., as shown by the difference 86 between the curve with a Peltier device 88 and the curve without a Peltier device 90. This temperature decrease is achieved because the Peltier device pumps heat away from the x-ray tube, causing the fin structure 80 to run hotter, allowing for increased convective cooling, while the shaft 58 and bearing assembly 50 run cooler, enhancing x-ray tube 12 performance.

Although the present invention has been described with reference to preferred embodiments, other embodiments may achieve the same results. Variations in and modifications to the present invention will be apparent to those skilled in the art and the following claims are intended to cover all such equivalents.

What is claimed is:

1. An x-ray generating device for generating x-rays, the x-ray generating device comprising:

a vacuum vessel having an inner surface forming a vacuum chamber;

an anode assembly disposed within the vacuum chamber, the anode assembly including a target;

a cathode assembly disposed within the vacuum chamber at a distance from the anode assembly, the cathode assembly configured to emit electrons that strike the target of the anode assembly, producing x-rays and residual energy in the form of heat;

a shaft coupled to the vacuum vessel by a bearing assembly, the shaft having a first end and a second end, the first end of the shaft having a support for supporting the target; and a thermal gradient device positioned adjacent to and in thermal communication with the second end of the shaft, the thermal gradient device operable for transferring heat away from the second end of the shaft.

2. The x-ray generating device of claim 1, further comprising a fin structure positioned adjacent to and in thermal communication with the thermal gradient device, the fin structure operable for convectively cooling the thermal gradient device.

3. The x-ray generating device of claim 1, wherein the thermal gradient device comprises two dissimilar conductors and receives an electrical current.

4. The x-ray generating device of claim 1, wherein the thermal gradient device comprises a Peltier device.

5. The x-ray generating device of claim 1, wherein the shaft further comprises a heat pipe disposed within the shaft.

6. The x-ray generating device of claim 5, wherein the heat pipe further comprises an evacuated sealed metal pipe partially filled with a fluid.

7. The x-ray generating device of claim 5, wherein the heat pipe further comprises an evaporator end, a condenser end, and internal walls having a capillary wick structure, the capillary wick structure providing for the transfer of fluid from the condenser end to the evaporator end of the heat pipe.

8. The x-ray generating device of claim 1, wherein the thermal gradient device and fin structure reduce the operating temperature of the bearing assembly and shaft by about 40 degrees C. to about 100 degrees C.

9. The x-ray generating device of claim 1, wherein the thermal gradient device and fin structure reduce the operating temperature of the bearing assembly and shaft by such an amount that lead or vacuum grease may be used to lubricate the bearing assembly during operation of the device.

10. An x-ray generating device for generating x-rays, the x-ray generating device comprising:

a vacuum vessel having an inner surface forming a vacuum chamber;

an anode assembly disposed within the vacuum chamber, the anode assembly including a target;

a cathode assembly disposed within the vacuum chamber at a distance from the anode assembly, the cathode assembly configured to emit electrons that strike the target of the anode assembly, producing x-rays and residual energy in the form of heat;

a shaft coupled to the vacuum vessel by a bearing assembly, the shaft having a first end and a second end, the first end of the shaft having a support for supporting the target;

a thermal gradient device positioned adjacent to and in thermal communication with the second end of the shaft, the thermal gradient device operable for transferring heat away from the second end of the shaft; and a fin structure positioned adjacent to and in thermal communication with the thermal gradient device, the fin structure operable for convectively cooling the thermal gradient device.

11. The x-ray generating device of claim 10, wherein the thermal gradient device comprises two dissimilar conductors and receives an electrical current.

12. The x-ray generating device of claim 11, wherein the thermal gradient device comprises a Peltier device.

13. The x-ray generating device of claim 10, wherein the shaft further comprises a heat pipe disposed within the shaft.

14. The x-ray generating device of claim 13, wherein the heat pipe further comprises an evacuated sealed metal pipe partially filled with a fluid.

15. The x-ray generating device of claim 14, wherein the heat pipe further comprises an evaporator end, a condenser end, and internal walls having a capillary wick structure, the capillary wick structure providing for the transfer of fluid from the condenser end to the evaporator end of the heat pipe.

16. The x-ray generating device of claim 10, wherein the thermal gradient device and fin structure reduce the operating temperature of the bearing assembly and shaft by about 40 degrees C. to about 100 degrees C.

17. The x-ray generating device of claim 10, wherein the thermal gradient device and fin structure reduce the operating temperature of the bearing assembly and shaft by such an amount that lead or vacuum grease may be used to lubricate the bearing assembly during operation of the device.

18. A thermal energy transfer device for use with an x-ray generating device comprising an anode assembly having a target, a cathode assembly at a distance from the anode assembly configured to emit electrons that strike the target, producing x-rays and residual energy in the form of heat, and a rotatable shaft supported by a bearing assembly, the thermal energy transfer device comprising:

a thermal gradient device positioned adjacent to and in thermal communication with one end of the shaft, the thermal gradient device operable for transferring heat away from that end of the shaft; and a fin structure positioned adjacent to and in thermal communication with the thermal gradient device, the fin structure operable for convectively cooling the thermal gradient device.

19. The thermal energy transfer device of claim 18, wherein the shaft is made of a thermally conductive material.

20. The thermal energy transfer device of claim 18, wherein the shaft further comprises a heat pipe disposed within the shaft.

21. The thermal energy transfer device of claim 20, wherein the heat pipe further comprises an evacuated sealed metal pipe partially filled with a fluid.

22. The thermal energy transfer device of claim 20, wherein the heat pipe further comprises an evaporator end, a condenser end, and internal walls having a capillary wick structure, the capillary wick structure providing for the transfer of fluid from the condenser end to the evaporator end of the heat pipe.

23. The thermal energy transfer device of claim 18, wherein the thermal gradient device comprises a Peltier device.

24. The thermal energy transfer device of claim 18, wherein the thermal gradient device and fin structure reduce the operating temperature of the bearing assembly and shaft by such an amount that lead or vacuum grease may be used to lubricate the bearing assembly.

25. A thermal energy transfer device for use with an x-ray generating device comprising an anode assembly having a target, a cathode assembly at a distance from the anode assembly configured to emit electrons that strike the target, producing x-rays and residual energy in the form of heat, and a rotatable shaft supported by a bearing assembly, the thermal energy transfer device comprising:

a Peltier device positioned adjacent to and in thermal communication with one end of the shaft, the Peltier device operable for transferring heat away from that end of the shaft; and a fin structure positioned adjacent to and in thermal communication with the Peltier device, the fin structure operable for convectively cooling the Peltier device.

26. The thermal energy transfer device of claim 25, wherein the shaft is made of a thermally conductive material.

27. The thermal energy transfer device of claim 25, wherein the shaft further comprises a heat pipe disposed within the shaft.

28. The thermal energy transfer device of claim 27, wherein the heat pipe further comprises an evacuated sealed metal pipe partially filled with a fluid.

29. The thermal energy transfer device of claim 28, wherein the heat pipe further comprises an evaporator end, a condenser end, and internal walls having a capillary wick structure, the capillary wick structure providing for the transfer of fluid from the condenser end to the evaporator end of the heat pipe.

30. The thermal energy transfer device of claim 25, wherein the Peltier device and fin structure reduce the operating temperature of the bearing assembly and shaft by such an amount that lead or vacuum grease may be used to lubricate the bearing assembly.

31. An x-ray system, comprising:

a vacuum vessel having an inner surface forming a vacuum chamber;

an electron source disposed within the vacuum chamber, the electron source operable for emitting electrons;

an x-ray source disposed within the vacuum chamber, the x-ray source operable for receiving electrons emitted by the electron source, producing x-rays and residual energy in the form of heat;

a shaft coupled to the vacuum vessel by a bearing assembly, the shaft having a first end and a second end, the first end of the shaft having a support for supporting the x-ray source; and a thermal energy transfer device positioned adjacent to and in thermal communication with the second end of the shaft, the thermal energy transfer device operable for transferring heat away from the second end of the shaft.

32. The x-ray system of claim 31, wherein the thermal energy transfer device further comprises a thermal gradient device positioned adjacent to and in thermal communication with the second end of the shaft, the thermal gradient device operable for transferring heat away from the second end of the shaft.

33. The x-ray system of claim 32, wherein the thermal energy transfer device a further comprises a fin structure positioned adjacent to and in thermal communication with the thermal gradient device, the fin structure operable for convectively cooling the thermal gradient device.

34. The x-ray system of claim 31, wherein the bearing assembly provides for rotational movement of the shaft and support for supporting the x-ray source.

35. The x-ray system of claim 31, wherein the shaft further comprises a heat pipe disposed within the shaft.

36. The x-ray system of claim 35, wherein the heat pipe further comprises an evacuated sealed metal pipe partially filled with a fluid.

37. The x-ray system of claim 35, wherein the heat pipe further comprises an evaporator end, a condenser end, and internal walls having a capillary wick structure, the capillary wick structure providing for the transfer of fluid from the condenser end to the evaporator end of the heat pipe.

38. The x-ray system of claim 31, wherein the thermal gradient device comprises a Peltier device.

39. The x-ray system of claim 31, wherein the thermal energy transfer device reduces the operating temperature of the bearing assembly and shaft by such an amount that lead or vacuum grease may be used to lubricate the bearing assembly during operation of the system.

40. The x-ray system of claim 28, wherein said x-ray system comprises a system selected from the group consisting of mammography, radiography, angiography, computed tomography (CT), fluoroscopy, vascular, mobile, and industrial x-ray.

41. An x-ray system, comprising:

a vacuum vessel having an inner surface forming a vacuum chamber;

an electron source disposed within the vacuum chamber, the electron source operable for emitting electrons;

an x-ray source disposed within the vacuum chamber, the x-ray source operable for receiving electrons emitted by the electron source, producing x-rays and residual energy in the form of heat;

a rotatable shaft coupled to the vacuum vessel by a bearing assembly, the shaft having a first end and a second end, the first end of the shaft having a support for supporting the x-ray source;

a thermal gradient device positioned adjacent to and in thermal communication with the second end of the shaft, the thermal gradient device operable for transferring heat away from the second end of the shaft; and a fin structure positioned adjacent to and in thermal communication with the thermal gradient device, the fin structure operable for convectively cooling the thermal gradient device.

42. The x-ray system of claim 41, wherein the shaft further comprises a heat pipe disposed within the shaft.

43. The x-ray system of claim 42, wherein the heat pipe further comprises an evacuated sealed metal pipe partially filled with a fluid.

44. The x-ray system of claim 43, wherein the heat pipe further comprises an evaporator end, a condenser end, and internal walls having a capillary wick structure, the capillary wick structure providing for the transfer of fluid from the condenser end to the evaporator end of the heat pipe.

45. The x-ray system of claim 41, wherein the thermal gradient device comprises a Peltier device.

46. The x-ray system of claim 41, wherein the thermal gradient device and fin structure reduce the operating temperature of the bearing assembly and shaft by such an amount that lead or vacuum grease may be used to lubricate the bearing assembly during operation of the system.

47. The x-ray system of claim 41, wherein said x-ray system comprises a system selected from the group consisting of mammography, radiography, angiography, computed tomography (CT), fluoroscopy, vascular, mobile, and industrial x-ray.

* * * * *